US012048382B2

(12) United States Patent
Wang et al.

(10) Patent No.: US 12,048,382 B2
(45) Date of Patent: Jul. 30, 2024

(54) CUSHION SUPPORTING STRUCTURE

(71) Applicant: Jianwu Wang, Dongguan (CN)

(72) Inventors: Jianwu Wang, Dongguan (CN); Yongqi Wang, Dongguan (CN)

( * ) Notice: Subject to any disclaimer, the term of this patent is extended or adjusted under 35 U.S.C. 154(b) by 7 days.

(21) Appl. No.: 17/856,314

(22) Filed: Jul. 1, 2022

(65) Prior Publication Data

US 2024/0000234 A1 Jan. 4, 2024

(51) Int. Cl.

| | |
|---|---|
| ***A47C 7/14*** | (2006.01) |
| ***A47C 7/02*** | (2006.01) |
| ***A47C 7/28*** | (2006.01) |
| ***A47C 7/30*** | (2006.01) |
| ***A47C 7/32*** | (2006.01) |

(52) U.S. Cl.

CPC ..... *A47C 7/14* (2013.01); *A47C 7/028* (2013.01); *A47C 7/285* (2013.01); *A47C 7/30* (2013.01); *A47C 7/32* (2013.01)

(58) Field of Classification Search

CPC .. A47C 7/14; A47C 7/32; A47C 7/028; A47C 7/285; A47C 7/30

USPC ... 297/284.3, 230.1, 230.11, 230.12, 230.13, 297/230.14, 452.63, 452.52, 452.53

See application file for complete search history.

(56) References Cited

U.S. PATENT DOCUMENTS 614,153 A * 11/1898 West ..... B60N 2/882 297/230.11
2,059,597 A * 11/1936 Okano ..... B60N 2/7005 D11/202
2,375,289 A * 5/1945 Deutsch ..... A47C 7/285 267/102
2,582,115 A * 1/1952 Goodeve ..... A47C 7/425 297/230.11
3,057,613 A * 10/1962 Moss ..... A47C 7/22 297/452.63 X
3,088,773 A * 5/1963 Horrocks ..... A47C 7/282 297/452.63 X
3,679,261 A * 7/1972 Slabakov ..... A47C 7/425 297/452.64 X
5,403,067 A * 4/1995 Rajaratnam ..... A61G 5/10 297/230.11
5,570,874 A * 11/1996 Tornero ..... F16F 1/08 297/452.63 X
5,645,321 A * 7/1997 Seroldi ..... A47C 31/04 297/452.63 X
5,957,532 A * 9/1999 Watkins ..... A61G 5/1091 297/452.63

(Continued)

FOREIGN PATENT DOCUMENTS

WO WO-9206622 A1 * 4/1992 ..... A47C 7/46

*Primary Examiner* — Rodney B White

(57) ABSTRACT

A self-adaption breathable cushion comprises a fixed base and a plurality of self-adaptive units integrated side by side and disposed on the fixed base; each of the adaptive units comprises a strap and an elastic member, the elastic member supports the strap to tension above the fixing base; when the strap is pressed and recessed, the elastic member deforms, so that the whole self-adaptive unit moves downwards; when the pressure is removed, the elastic member is reset, and the strap is also reset. The self-adaptive breathable cushion can be deformed self-adaptively according to the weight of a human body to be borne, so as to be attached to the human body, making the human body more comfortable.

18 Claims, 12 Drawing Sheets

(56) References Cited

U.S. PATENT DOCUMENTS

| | | | | |
|---|---|---|---|---|
| 6,398,310 | B1 * | 6/2002 | Seeliger | A47C 7/029 297/452.63 X |
| 6,971,717 | B1 * | 12/2005 | Rhodes | A47C 7/46 297/452.63 X |
| 7,568,769 | B1 * | 8/2009 | Chuang | A47C 31/04 297/452.63 |
| 7,648,201 | B2 * | 1/2010 | Eysing | A47C 7/46 297/284.3 |
| 7,651,163 | B2 * | 1/2010 | Jaskot | A47C 7/425 297/230.11 |
| 7,748,738 | B2 | 7/2010 | Schneider | |
| 7,909,402 | B2 * | 3/2011 | Chu | A47C 7/465 297/284.3 |
| 8,185,985 | B2 * | 5/2012 | Coffield | A47C 23/061 297/452.63 X |
| 8,875,331 | B2 | 11/2014 | Taylor | |
| 9,486,081 | B2 * | 11/2016 | Sander | A47C 7/44 |
| 9,688,174 | B2 | 6/2017 | Dry et al. | |
| 11,723,471 | B2 * | 8/2023 | Rajaratnam | A47C 7/46 297/284.4 |
| 2006/0061195 | A1 * | 3/2006 | Snyders | A47C 4/022 297/452.63 |
| 2014/0159450 | A1 * | 6/2014 | Guering | B64D 11/06 297/284.3 |

* cited by examiner

CUSHION SUPPORTING STRUCTURE

FIELD OF THE INVENTION

The present invention relates to the technical field of cushions, particularly, to a cushion supporting structure.

BACKGROUND OF THE INVENTION

Cushions are widely used in people's lives, such as sofa cushions, seat cushions, mattresses, automotive seat cushions, pillows, etc. Current cushions are generally composed of a coat and a filling material disposed on the coat. The coat is generally a flexible cloth or a sheath, and the filling material is generally sponge, latex, or the like. These cushions provide a soft support to the human body so that people feel comfortable.

However, these cushions have some obvious defects. The first one is difficulty in cleaning. When the surface of the cushion is soiled or liquid such as fruit juice or milk enters the filling through the coat, the cushion cannot be cleaned. The second is that this type of cushion cannot sufficiently kill bacteria, mites and the like in the filling even if the cushion is exposed to sunlight for sunburn. The third one is air-proof and air-permeable.

To this end, it is necessary to develop a new cushion support structure, so as to replace a filler in a current cushion to provide soft support for a user's body, and at the same time, overcome the defects that the existing cushion is not easy to clean, is not easy to desterilize, has no ventilation and low heat dissipation.

SUMMARY OF THE INVENTION

For overcoming the defects of the prior art, the present invention provides a cushion supporting structure, which can adaptively deform according to a pressure applied thereto, and provides a soft support to the user's body. In addition, the present invention overcomes the shortcomings of the prior art that the cushion is not ventilated and breathable, has low heat dissipation, is not easy to clean, is not easy to desterilize, and has a short service life.

The technical schemes of the present invention are as follows:

A cushion supporting structure, comprising a fixing base and a plurality of self-adaptive units integrated side by side and disposed on the fixing base; each of the self-adaptive units comprises a flexible bearing member and an elastic member; the elastic member supports the flexible bearing member and tension it; each the elastic member has two symmetrical rod ends, and the flexible bearing member is fixedly connected to the rod ends; when the flexible bearing member is pressed by a pressure and recessed downwards, pulling the rod ends of the elastic member connected thereto to move relatively close to each other so that the elastic member is deformed; when the pressure is removed, the elastic member is reset under its elasticity, and the flexible bearing member is restored to tension.

The elastic member is an elastic rod comprising the rod ends and an arc-shaped rod body integrally; or the elastic member comprises the rod ends with an arc-shaped body or a straight rod body integrally, and the rod ends being symmetrically mounted on a mounting member; or two arc-shaped rod bodies are arranged in parallel, and the ends of the two arc-shaped rod bodies are connected to form the rod ends; or the elastic member is composed of two U-shaped members mounted on a mounting member, each of the two U-shaped members is formed by two arc-shaped rod bodies arranged in parallel, and the ends of the two arc-shaped rod bodies are connected to form a rod end; or the elastic member is an arc-shaped plate.

The cross section of the rod body is oval, circular, or polygonal in shape.

Each of the elastic members supports one of the flexible bearing members; or each of the elastic members supports a plurality of the flexible bearing members; or a plurality of the elastic members support one of the flexible bearing members.

The flexible bearing members is a strap or a flexible fabric block.

Each of the self-adaptive units further comprises a supporting member, supporting the elastic member to enable it to move up and down; the supporting member is disposed under, at both ends of, or above the elastic member.

The supporting member has elasticity and is deformed by being pressed or pulled by the elastic member, and is reset as the elastic member is reset.

The fixing base has two straight connecting rods, each of the straight connecting rods is provided with a plurality of holes corresponding to the rod ends; each of the rod ends passes through one of the holes and is defined to move within the holes.

The cross section of each of the holes is long elliptical.

The elastic member is made of epoxy fiber, aluminum alloy, carbon fiber, alumina, glass reinforced fiber, or spring steel, etc.

The radian of the elastic member is 8°-90°.

The rod body is sheathed with a thin coat.

A cushion supporting structure comprises a fixing base, a plurality of elastic members, and at least one flexible bearing member; the elastic members are arranged side by side at equal intervals on the fixing base, and each of the elastic members has two symmetrical two rod ends, and the rod ends are respectively fixedly connected to the fixing base in opposite directions; two opposite sides of the flexible bearing member are respectively connected to the fixing base, so as to set up the flexible bearing member above the elastic members; the flexible bearing member is deformed under the pressure, and pulls the fixing base connected thereto to move relatively close to each other so that the elastic members are deformed; when the pressure is removed, the elastic members are reset under its elasticity, and the flexible bearing is restored to tension.

Each of the elastic members has a rod body connected to the rod ends, and the joint of each of the two rod ends and the fixing base is set at an obtuse angle.

The fixing base comprises two straight connecting rods, multiple pairs of connecting cylinders are provided on the two straight connecting rods, and the rod ends of each of the elastic members are respectively inserted into one pair of the connecting cylinders.

The flexible bearing member is an elongated flexible strap or a block-shaped flexible knitted fabric.

The two opposite sides of the flexible bearing member are respectively folded back to fit with the main body portion thereof to form two folding structures; each of the two folding structures winds one of the two straight connecting rods, extends above the connecting cylinder and forms a first perforation; and a positioning rod passes through the perforation and is clamped on the straight connecting rod, thereby fixing the flexible bearing member on the fixing base.

The folding structure is further provided with a second perforation, and the positioning rod passes through all of the first perforations or all of the second perforations so as to tension the flexible bearing member.

A pillow supporting structure includes a fixing base, a plurality of elastic members arranged side by side on the fixing base, and at least one flexible bearing member; the fixing base has a first arc-shaped protrusion, a second arc-shaped protrusion, and a concave. The concave connects the first arc-shaped protrusion and the second arc-shaped protrusion, and the first arc-shaped protrusion is slightly higher than the second arc-shaped protrusion; each of the elastic members has two symmetrical rod ends arranged on the fixing base in opposite direction, to support the fixing base; two sides of the flexible bearing member are fixedly mounted on the fixing base, the flexible bearing member is tensioned above the elastic members; when the flexible bearing member is pressed by a pressure and recessed downwards, pulling the fixing base connected thereto to close relatively to each other, so that the elastic members are deformed; when the pressure is removed, the elastic members are reset under their own elasticity and push the fixing base to reset, and the flexible bearing member is also restored to tension.

The fixing base comprises two curved rods arranged side by side, or two panels arranged side by side, each of the two curved rods or the top surface of each of the panels includes the first arc-shaped protrusion, the second arc-shaped protrusion, and the concave, so that the flexible bearing member tensioned thereon presents a corresponding wavy shape.

The fixing base is further provided with two auxiliary curved rods, respectively close to the two curved rods or the top surfaces of the two panels, forming two gaps therebetween; two sides of the flexible bearing member respectively pass through the two gaps to be fixed on the fixing base.

The pillow supporting structure also further comprises a flexible pad covering the flexible bearing member.

The pillow supporting structure further comprises a flexible interlayer, the flexible interlayer can be selectively disposed between the elastic member and the flexible bearing member, or between the flexible bearing member and the flexible pad, or on the flexible pad.

The fixing base is provided with multiple pairs of connecting cylinders, and the rod ends of each of the elastic members are respectively plugged into one pair of the connecting cylinders.

The beneficial effects of the present invention are as follows: the cushion supporting structure integrates the self-adaptive unit on the fixing base, the flexible bearing member is deformed downwards when it is pressed, pulling the two rod ends of the elastic member to close to each other, when the pressure is removed, the elastic member is reset under its own elasticity and tension the flexible bearing member, the self-adaptive unit can be deformed according to the pressure and produce a self-adaptive effect, thereby preventing or improving lumbar spine disease.

The rod body or the arc-shaped plate in the self-adaptive unit can maintain elasticity for a long time, is not easy to age, has good fatigue resistance, which extends the service life of the cushion supporting structure.

The cushion supporting structure is wrapped with a coat to form a cushion. The cushion is ventilated and breathable, has fast heat dissipation, durable and long-lasting elastic force, and can be removed from the coat for directly cleaning and sterilizing after soiled use. The cushion is convenient to use.

In the cushion supporting structure, the flexible bearing member is fixed on the fixed base, the elastic member is arranged on the fixed base side by side at an equal interval when the flexible bearing member is deformed under the pressure applied thereto, it pulls the fixed base connected therewith to close to each other, the elastic member is deformed, when the pressure is removed, the elastic member is reset under its own elasticity, it pushes the fixed base to reset, the flexible bearing member is restored to tension. The type of cushion supporting structure is suitable for seat cushion, pillows and backrests and the likes.

In the pillow supporting structure, the fixing base has the first arc-shaped protrusion, the second arc-shaped protrusion and the concave so that the flexible bearing member deposed thereon presents the corresponding wavy shape to adapt the physiological curve with the human head and neck. When the human neck is placed on an area of the flexible bearing member between two of the first arc-shaped protrusions or the other an area of the flexible bearing member between two of the second arc-shaped protrusions, the human head is naturally placed on another area of the flexible bearing member between two of the concave. When the flexible bearing member in each area is deformed under the pressure, pulling the fixing base connected thereto to move relatively close, and driving the elastic member to deform, so as to generate an adaptive physiological radian of the human head and neck, thereby ensuring the health of the head and neck, preventing, correcting, relieving or treating cervical spondylosis; when the pressure is removed, the elastic member is reset, the fixing seat is pushed to reset, and the flexible bearing member is also reset to tension.

BRIEF DESCRIPTION OF THE DRAWINGS

In order to more clearly illustrate the technical schemes in the embodiments in the present invention, the drawings needed in the embodiments or the prior technical description are briefly introduced below. Obviously, the drawings described below are only some embodiments in the present invention, and for those skilled in the art, additional drawings may be obtained according to the drawings below without creative work.

DETAILED DESCRIPTION OF ILLUSTRATED EMBODIMENTS

Figure 1:
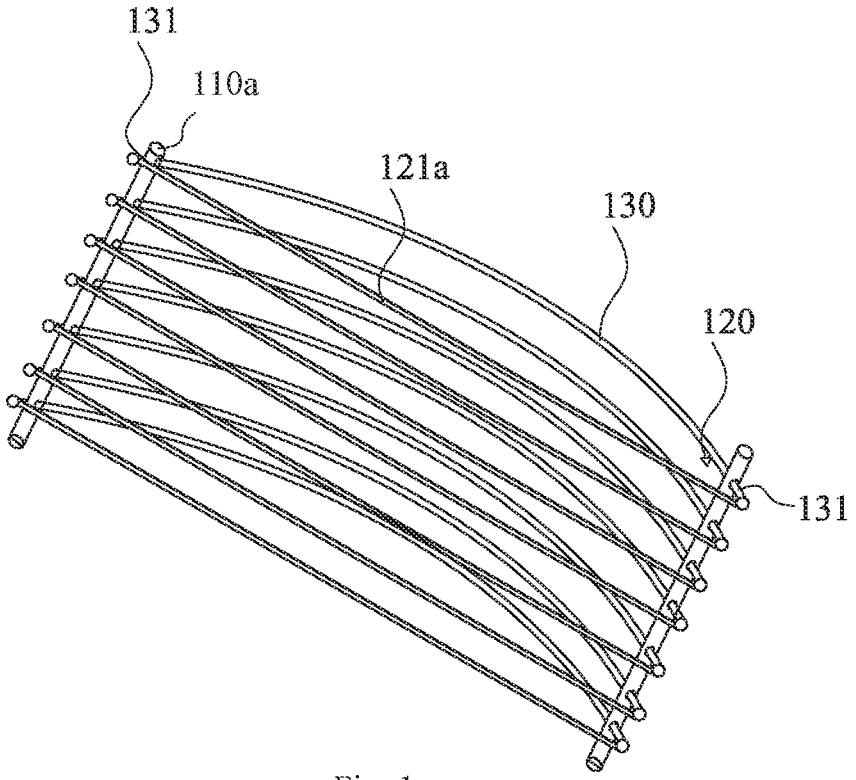
FIG. 1 is a perspective view of the cushion supporting structure according to the present invention.

Referring to FIGS. 1, 2, 3 and 4, a cushion supporting structure 100 includes a fixing base 110*a* and a plurality of self-adaptive units 120 integrated on the fixing 110 side by side. Each of the self-adaptive units 120 includes a flexible bearing member 121 and an elastic member 130. The elastic member 130 supports the flexible bearing member 121 and tensions it. Each of the elastic member 130 has two symmetrical rod ends 131. The flexible bearing member 121 is fixedly connected with the rod ends 131 of the elastic member 30. When flexible bearing member 121 is pressed by a pressure and recessed downwards, thereby pulling the rod ends 131 of the elastic member 130 connected therewith to move relatively close to one another so that the elastic member 130 is deformed, when the pressure is removed, the elastic member 130 is reset under its own elasticity, the flexible bearing member 121 is reset to tension.

Figure 5:
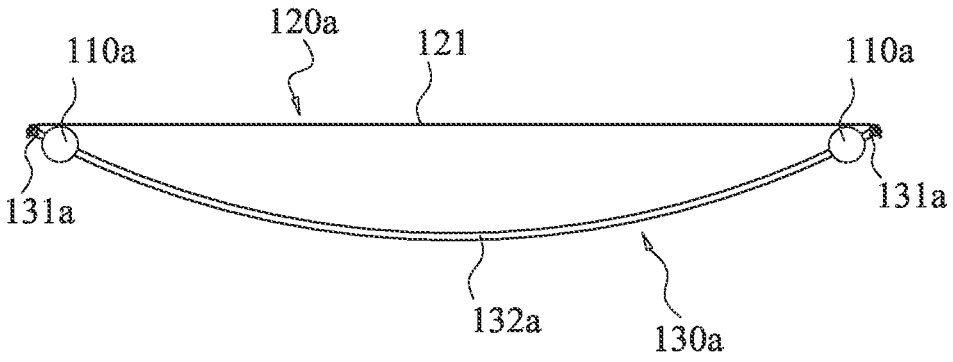
FIG. 5 is a front view of the cushion supporting structure shown in FIG. 1.
Figure 6:
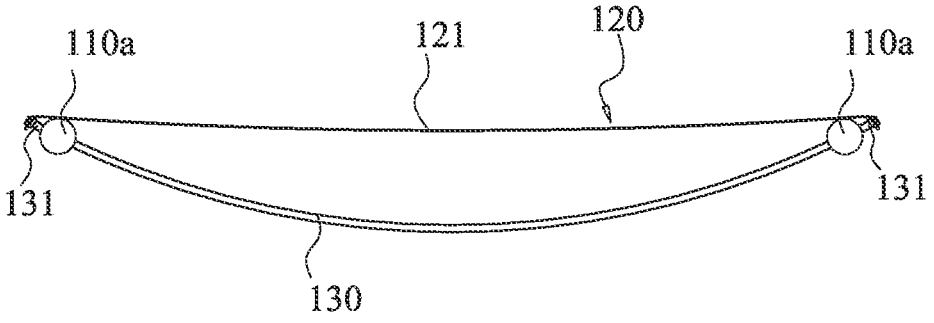
FIG. 6 is a perspective view of the cushion supporting structure in another embodiment according to the present invention.

It should be understood that the term "tension" used in the present invention means that the elastic member 130 supports the flexible bearing member 121 to be in a straightly stretched state, as shown in FIG. 5, or in a natural state with a slightly droop radian, as shown in FIG. 6. In particular, when the flexible bearing member 121 is an elongated flexible strap 121*a* or a block-shaped flexible braid 121*b*, the term "tension" as used herein may be in a straightly stretched state, as shown in FIG. 5, or in a natural state with a slightly droop radian, as shown in FIG. 6.

Figure 7:
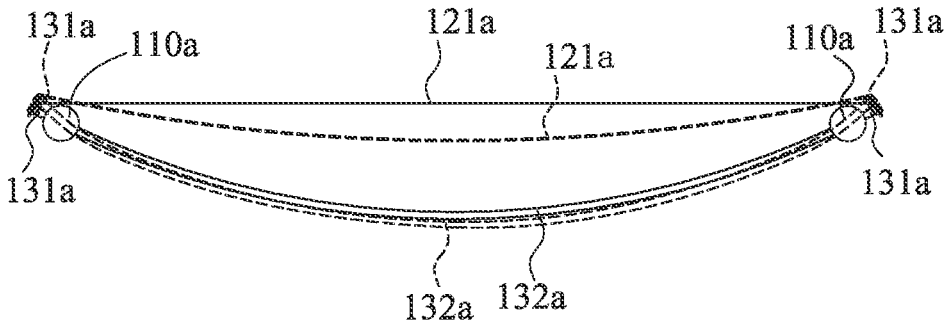
FIG. 7 is a schematic diagram showing a post-stress change state of the cushion supporting structure according to the present invention, wherein a solid line indicates a pre-stress state, and a dotted line indicates a post-stress deformation state.

In some embodiment according to the present invention, referring to FIG. 5, the elastic member 130*a* is an arc-shaped elastic rod comprising the two rod ends 131*a* and an arc-shaped rod body 132*a* integrally. The elastic member 130*a* in this embodiment and the elongated flexible strap 121*a* form the adaptive unit 120*a* in the 'bow' shape. Referring to FIG. 7, the changing state, after the force is applied to the self-adaptive unit, is illustrated by dotted lines. When the elongated flexible strap 121*a* is pressed by pressure, for example, a human body presses on it, the elongated flexible strap 121*a* is recessed and deformed in the direction of the arc-shaped elastic rod, so as to generate an radian adaptive to the human body, and at the same time, to pull the two rod ends 131*a* toward the central direction of the 'bow', and the central portion of the arc-shaped elastic rod is further recessed. When the human body leaves the strap 121*a* and the pressure is removed, the elastic rod is reset under its own elasticity, and the elongated flexible strap 121*a* also resets to the tension state.

Figure 2:
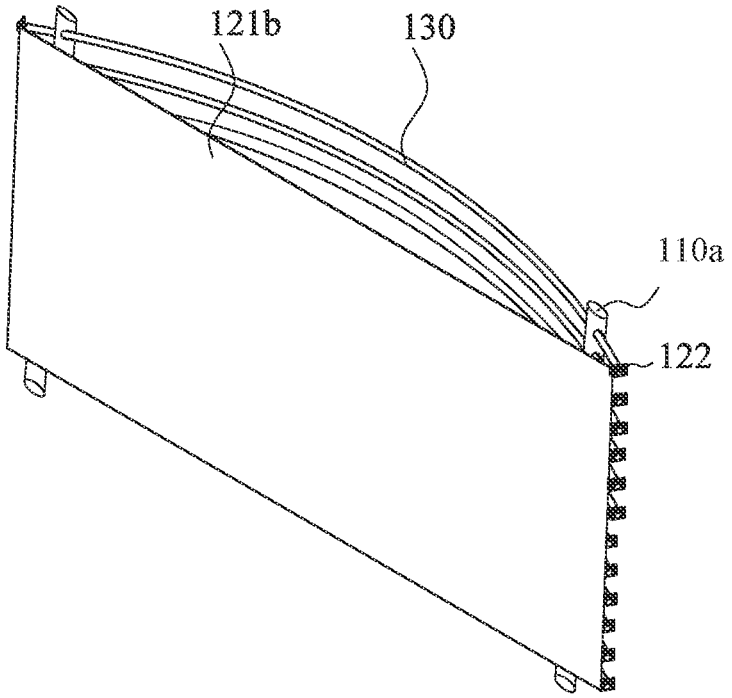
FIG. 2 is a perspective view of the cushion supporting structure in the other embodiment according to the present invention.

It should be understood that the elastic member 130*a* can be used with the block-shaped flexible braid 121*b*. Referring to FIG. 2, the block-shaped flexible braid 121*b* can be used with a plenty of the elastic member 130*a*. When the block-shaped flexible braid 121*b* is deformed to recess towards the elastic member 130*a* under the pressure, for example, a human body presses on it, to generate a radian adaptive to the human body, at the same time, to pull all of the two rod ends 131*a* of all of the elastic members 130*a* toward the central directions of the elastic members 130*a*, and the central portions of the elastic members 130*a* are further recessed. When the pressure is removed, for example, the human leaves the block-shaped flexible braid 121*b*, all of the elastic members 130*a* are reset, and the block-shaped flexible braid 121*b* is also reset. In the embodiment, the number of the elastic members 130*a* is decided by the size of the block-shaped flexible braid 121*b*.

Figure 8:
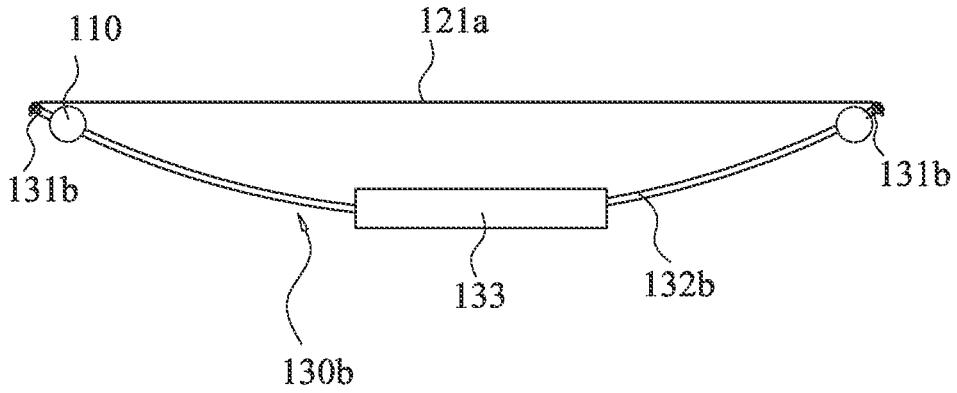
FIG. 8 is a perspective view of the self-adaptive unit in another embodiment according to the present invention.

In some embodiment according to the present invention, referring to FIG. 8, the elastic member 130*b* has two elastic rods formed by molding the two rod ends with a rod body integrally, the rod body is an arc-shaped body or a straight body, and the two elastic rods being symmetrically mounted on a mounting member 133. The mounting member 133 may be a straight rod, a plate, or a frame. The present invention does not uniquely limit the structure of the mounting member 133, as long as the structure can meet "can be symmetrically installed the elastic rod, and can not shake on the ground". The elastic member 130*b* can be used with the elongated flexible strap 121*a* or the block-shaped flexible braid 121*b*. It should be understood that when the elastic member 130*b* is used with the elongated flexible strap 121*a*, one of the mounting members 133 only mounts two of the elastic rods, when the elastic member 130*b* is used with the block-shaped flexible braid 121*b*, one of the mounting member 133 mounts a plenty of the elastic rods.

Figure 9:
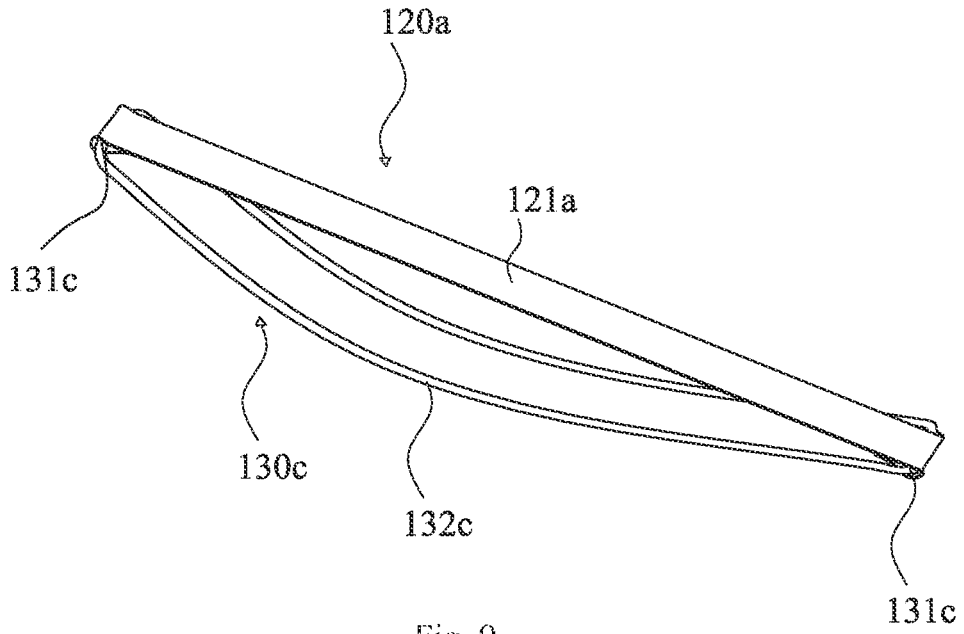
FIG. 9 is a perspective view of the self-adaptive unit in another embodiment according to the present invention.

In some embodiments according to the present invention, referring to FIG. 9, the elastic member 130*c* has two arc-shaped rod bodies arranged in parallel, and the ends of the two arc-shaped rod bodies are respectively connected to form the two rod ends 131*c*. The elastic member 130*c* can be used with the elongated flexible strap 121*a* or the block-shaped flexible braid 121*b*. When the elastic member 130*c* is used with the elongated flexible strap 121*a*, one of the elongated flexible strap 121*a* must be used only together with one of the elastic member 130*c*. When the elastic member 130*c* is used with the block-shaped flexible braid 121*b*, one of the block-shaped flexible braid 121*b* must be used together with a plenty of the elastic members 130*c*.

Figure 10:
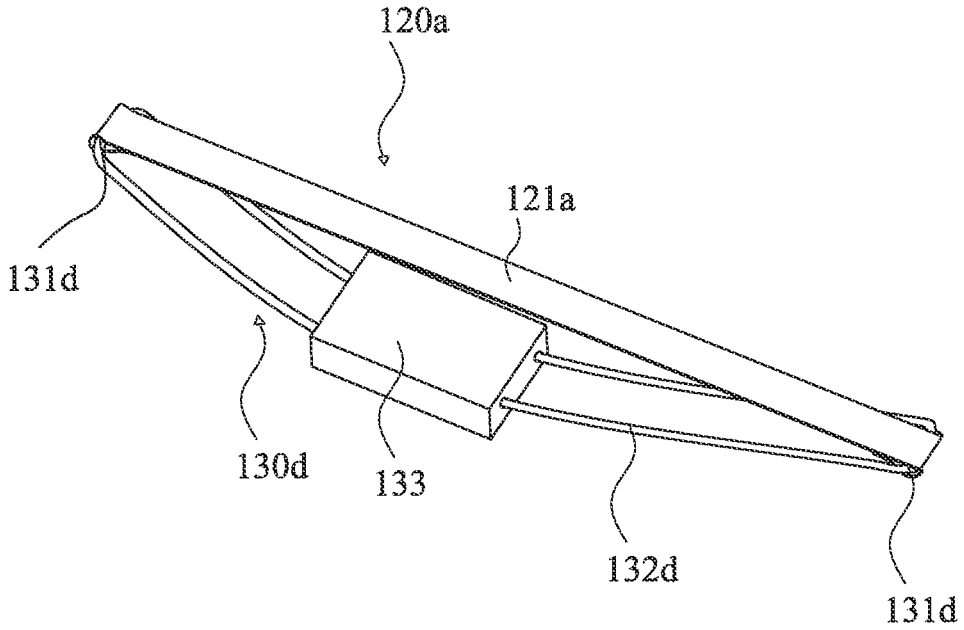
FIG. 10 is a perspective view of the self-adaptive unit in another embodiment according to the present invention.

In some embodiments according to the present invention, referring to FIG. 10, the elastic member 130*d* is composed of two U-shaped members mounted on the mounting member 133, each of the two U-shaped members is formed by two arc-shaped rod bodies 132*d* arranged in parallel, and ends of the two arc-shaped rod bodies 132*d* are connected to form the rod end 131*d*. The two U-shaped members are arranged symmetrically on the mounting member 133. The elastic member 130*d* can be used with the elongated flexible strap 121*a* or the block-shaped flexible braid 121*b*. When the elastic member 130*d* is used with the elongated flexible strap 121*a*, one of the elongated flexible strap 121*a* must be used only together with one of the elastic member 130*d*. When the elastic member 130*d* is used with the block-shaped flexible braid 121*b*, one of the block-shaped flexible braid 121*b* must be used together with a plenty of the elastic members 130*d*.

Figure 11:
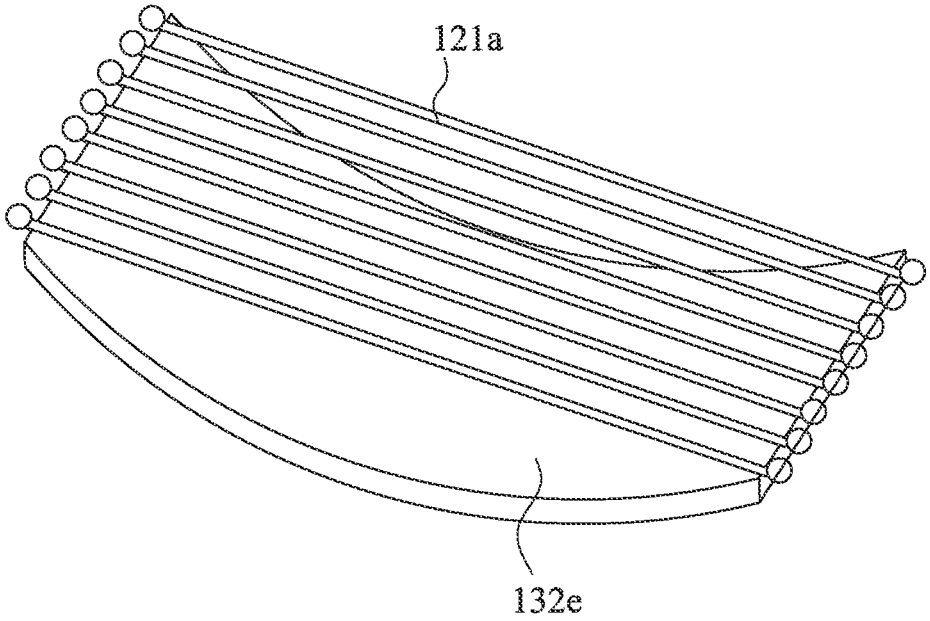
FIG. 11 is a perspective view of the self-adaptive unit in another embodiment according to the present invention.
Figure 12:
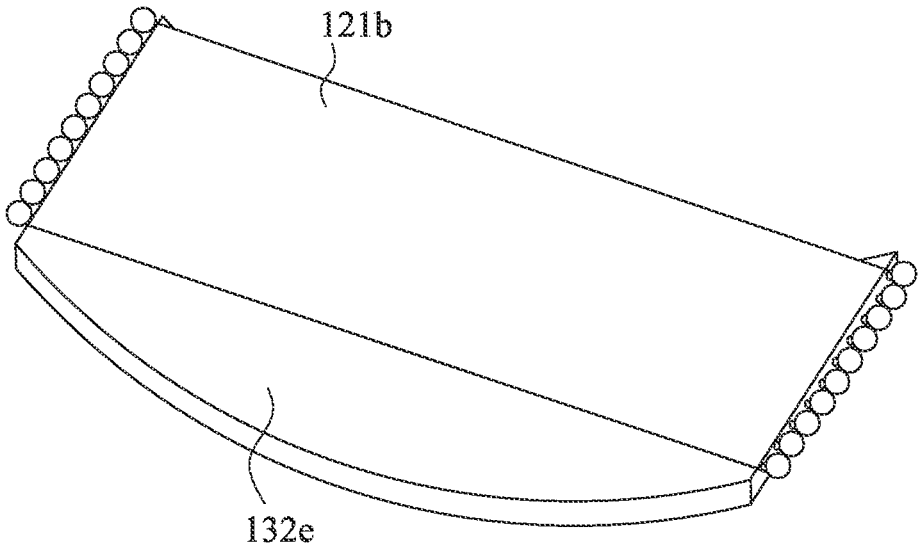
FIG. 12 is a perspective view of the self-adaptive unit in another embodiment according to the present invention.

In some embodiments according to the present invention, referring to FIGS. 11 and 12, the elastic member 130*e* is an arc-shaped plate 132*e*, a plenty of the elongated flexible strap 121*a* or the block-shaped flexible braid 121*b* is mounted on the arc-shaped plate 132*e*.

In some embodiments according to the present invention, the elastic member 130 and a flexible bearing member 120 are connected directly or connected by a connector 150. That is the edge of the flexible bearing member 120 is fixed with the rod end 131 of each of the elastic members 130. Specifically, In some embodiments, the end of the strap 121*a* is tied directly on the rod end of each of the elastic member 130, or the edge of the block-shaped flexible braid 121*b* has some belts, which are tied directly on the rod ends of the elastic members 130.

In some embodiments, the rod end 131 is provided with a through hole or a groove, if the flexible bearing member 120 is the elongated flexible strap 120*a*, the end of the elongated flexible strap 120*a* passes through the through hole or the groove, then fixed on the elongated flexible strap 120*a* to form a buckle. If the flexible bearing member 120 is block-shaped flexible braid 121*b*, the edge of the block-shaped flexible braid 121*b* is provided with a plenty of buckles each passes through the through hole or the groove of each of the rod end 131.

In some embodiments, the connector is used for fixedly connecting the flexible bearing member 120 and the rod end 131. Preferably, the connector is fixed on the rod end and connected with the flexible bearing member 120. The connector is provided with a structure to facilitate the fixed connection of the flexible bearing member 120, such as a groove or a through hole or the like.

In some embodiments, a cross-section of the rod end 131 is in the shape of a circular, preferably, an oval, a square, a rectangular, or a polygonal, thereby preventing the elastic member 130 from turning or shaking about itself when the flexible bearing member 120 pulls the elastic member 130.

In some embodiments, a cross-section of the rod body 131 is in the shape of a circular, preferably, an oval, a square, a rectangular, or a polygonal, thereby preventing the elastic member 130 from turning or shaking about itself when the flexible bearing member 120 pulls the elastic member 130.

In some embodiments, the elastic member 130 is made from epoxy resin fiber, aluminum alloy, carbon fiber, aviation aluminum, glass reinforced fiber, spring steel, etc. These materials have a certain degree of elasticity and bending resistance, which can deform when suffer the force, and can reset after the force disappears. The elastic force of the elastic member 130 is between 300 N and 10,000 N. The elastic force of the elastic member is set flexibly according to the objective needs.

In some embodiments, the rod body of the elastic member 130 has a radian of 8°-90°.

In some embodiments, the rod body of the elastic member 130 is sleeved by a thin coat. The thin coat is made of plastic, or stainless steel, etc. The thin coat protects the rod body and decorates the rod body for a beautiful shape, or strengthens the bending strength of the rod body and reducing the cost.

In some embodiments, the flexible bearing member 121 is cloth, fiber, nylon, etc.

Figure 3:
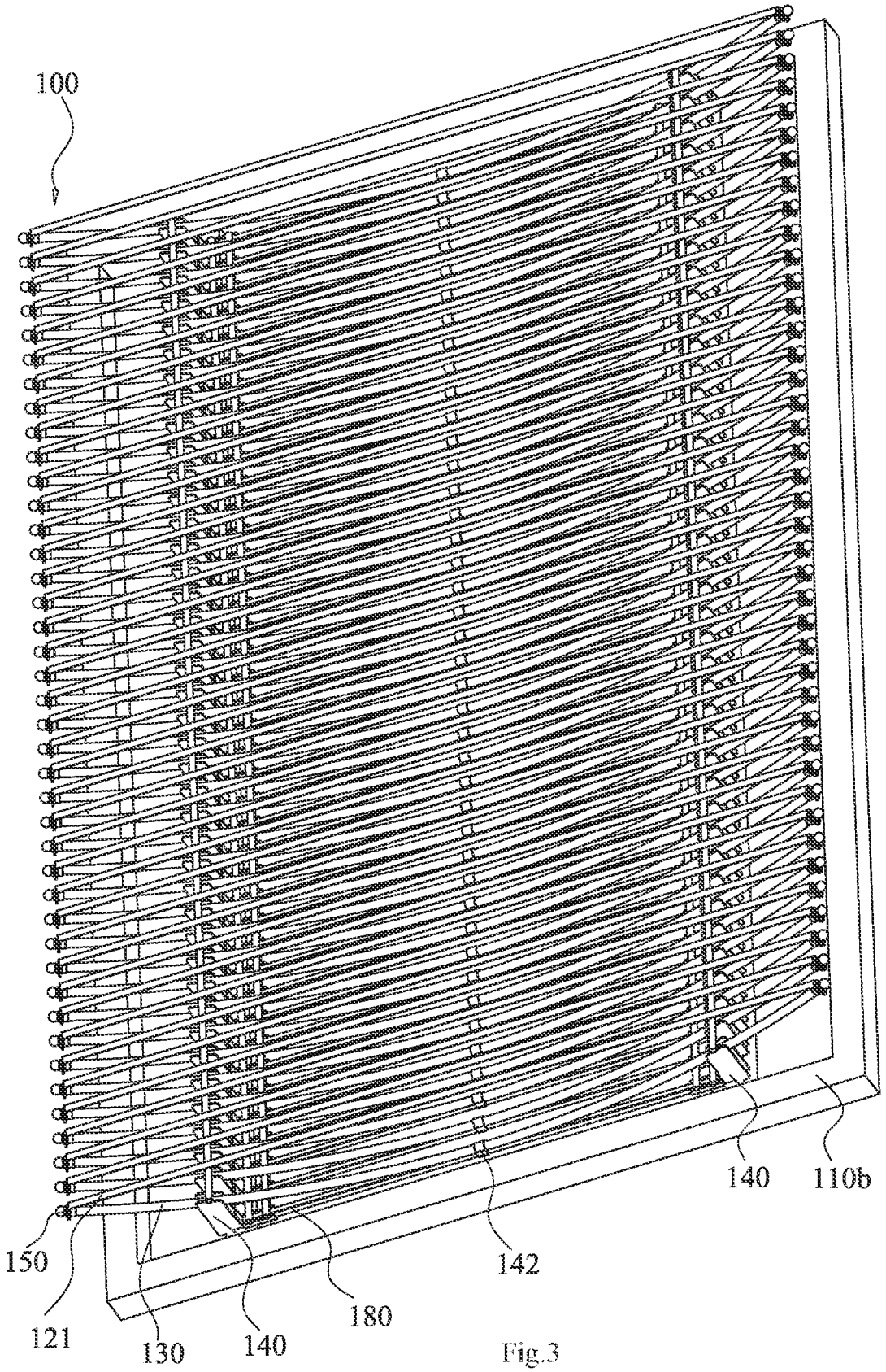
FIG. 3 is a perspective view of the cushion supporting structure in another embodiment according to the present invention.
Figure 4:
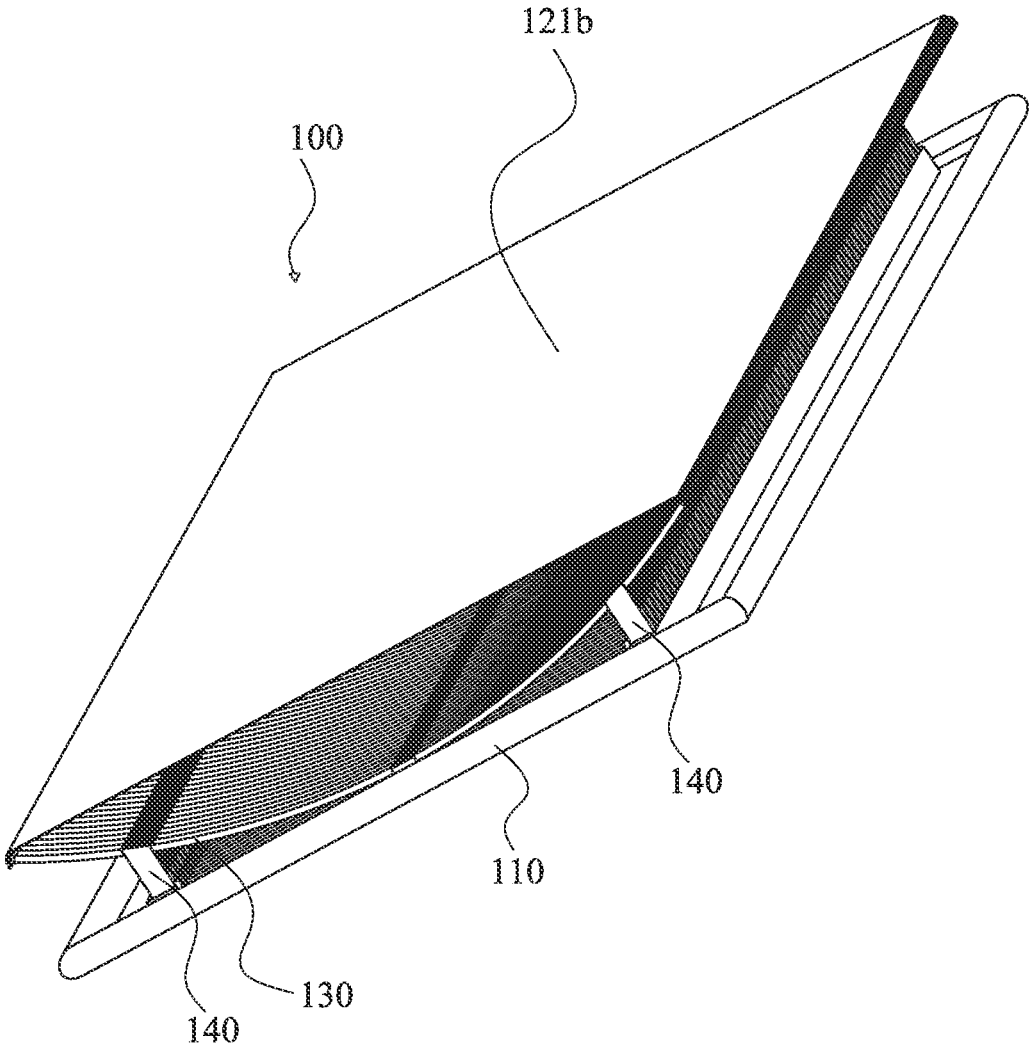
FIG. 4 is a perspective view of the cushion supporting structure in another embodiment according to the present invention.

In some embodiments, referring to FIG. 3, the self-adaptive unit 120 also includes a supporting member 140, which supports the elastic member 130 to be moved up and down. The supporting member 140 is arranged under, at two ends of, or above the elastic member 130. The structure of the supporting member 140 varies according to the structure of the elastic member 130 and its purpose of use, for example, to be an inelastic supporting member or an elastic supporting member. If the supporting member 140 is an inelastic supporting member, for example, a base, it must be provided with a containing slot adapted to the shape and the orientation of the rod body, thereby that the rod body can pass through it. The containing slot has a certain limiting effect, that is, to provide sufficient space for the rod body to deform, and to block the rod body from swaying in a front or a rear direction when deforms, only to deform in a left or a right direction, and an upper or a lower direction.

When the supporting member 140 is an elastic supporting member that supports elastically the elastic member 130 to move up and down, that is, when the elastic 130 moves down, it presses the elastic supporting member to deform so as to provide enough space for the elastic member 130 to move down. When the pressure on the flexible bearing member is removed, the elastic supporting member resets and pushes the elastic member 130 to reset. The elastic supporting member 140 enables the elastic member 130 to move up and down, so that the self-adaptive unit 120 can move up and down according to the borne weight, with good buffering effects and better adaptive effects, making people feel more comfortable. The elastic supporting member 140 preferably has structures such as a circular linear spring or shrapnel.

Preferably, the supporting member 140 is mounted to the fixing base 110*b*. Of course, the supporting member 140 may also be mounted on other structures, such as the aforementioned installation member 133.

Preferably, in some embodiments, the fixed base 110 includes a plenty of limiting members 180, each connected to the elastic members 130 one by one, used for limiting the elastic members 130 to only move up and down, and cannot swing left, right, front and back. Specifically, the elastic member 130 is provided with a mounting base 142. The limiting member 180 is a straight rod with elasticity as shown in FIG. 3, passes through a mounting base 142, and two ends of the limiting member 180 are fixed on the fixing base 110. The elastic member 130 and the limiting member 180 are fixedly connected by the mounting base 142. When the elastic member is pulled to deform by the flexible bearing member 130, it squeezes the limiting member 180 through the mounting base 142, The two ends of the limiting member 180 are fixed, it can move up and down, but cannot swing left, right, front and back, thereby limiting the move direction of the elastic member 130. Preferably, the limiting member 180 has two straight rods with elasticity arranged in parallel. It should be understood that the limiting member 180 also can be other structures that can satisfy "limiting the movement direction of the elastic member 130 to move only up and down".

Figure 13:
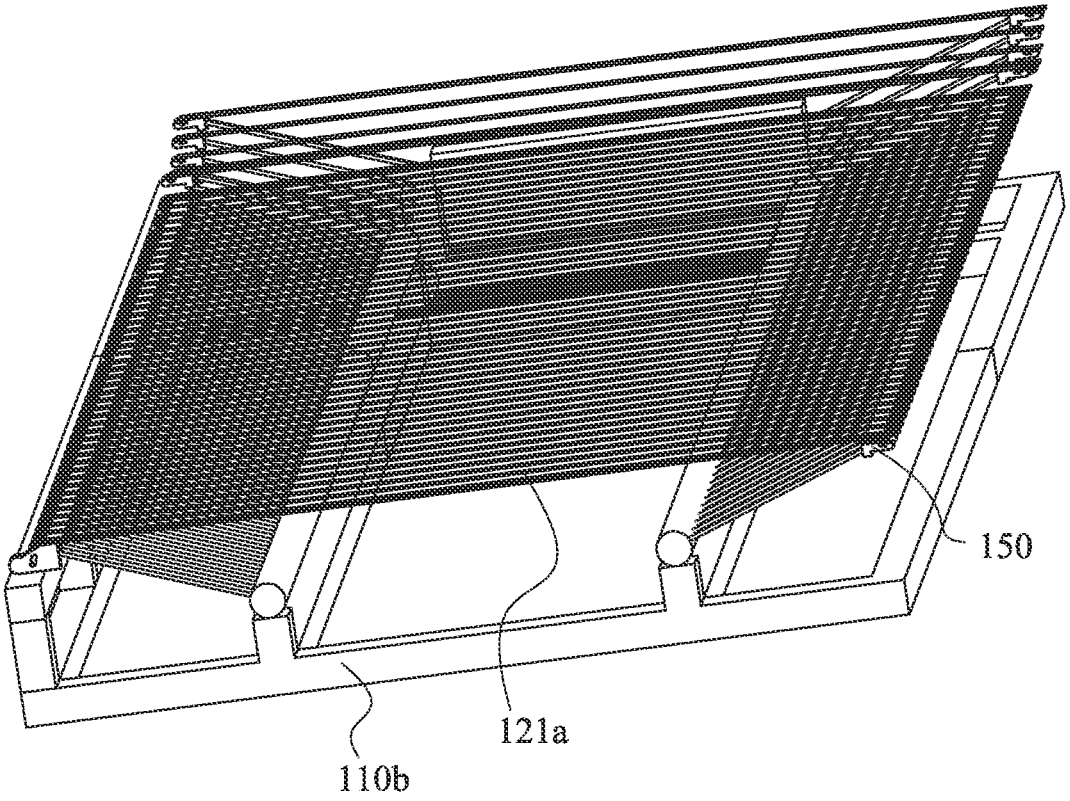
FIG. 13 is a perspective view of the cushion supporting structure in another embodiment according to the present invention.

It should be understood the function of the fixing base is to integrate the self-adaptive unit, whose structure varies flexibly according to the shape and the installation needs of the elastic member of the self-adaptive unit. For example, in some embodiments, if the cushion supporting structure is used in products such as throw pillows or back cushions, then the fixing base 110*a* may be configured as two side connecting straight rods, as shown in FIGS. 12 and 13, the side connecting straight rods are provided with a plurality of holes corresponding to the rod ends 131 one by one; each of the rod ends 131 passes through one of the holes and is defined to move within it. Preferably, each of the holes is in the shape of an oval and is bigger than each of the rod ends 131, thereby each of the rod ends 131 can pass through the hole and the rod body can move in the hole. The hole also limits the range of the movement of the rod body and prevents it from breaking because of transition deformation under pressure.

In some embodiments, if the cushion supporting structure 100 is used for products, such as a sofa cushion, an automobile seat, a pillow, and a mattress, that need to be fixed at a certain position, then the fixing base 110*b* is designed as a structure with a base and a bottom frame. The supporting member, the mounting seat, and the mounting member are fixedly disposed on the fixing base 110*b*, as shown in FIGS. 3 and 13.

Figure 14:
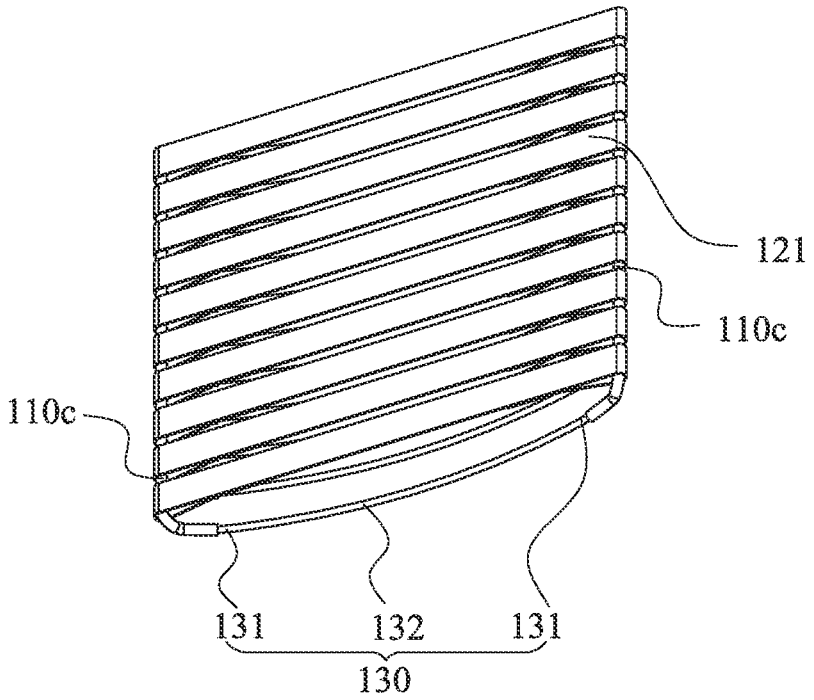
FIG. 14 is a perspective view of the cushion supporting structure in another embodiment according to the present invention.
Figure 15:
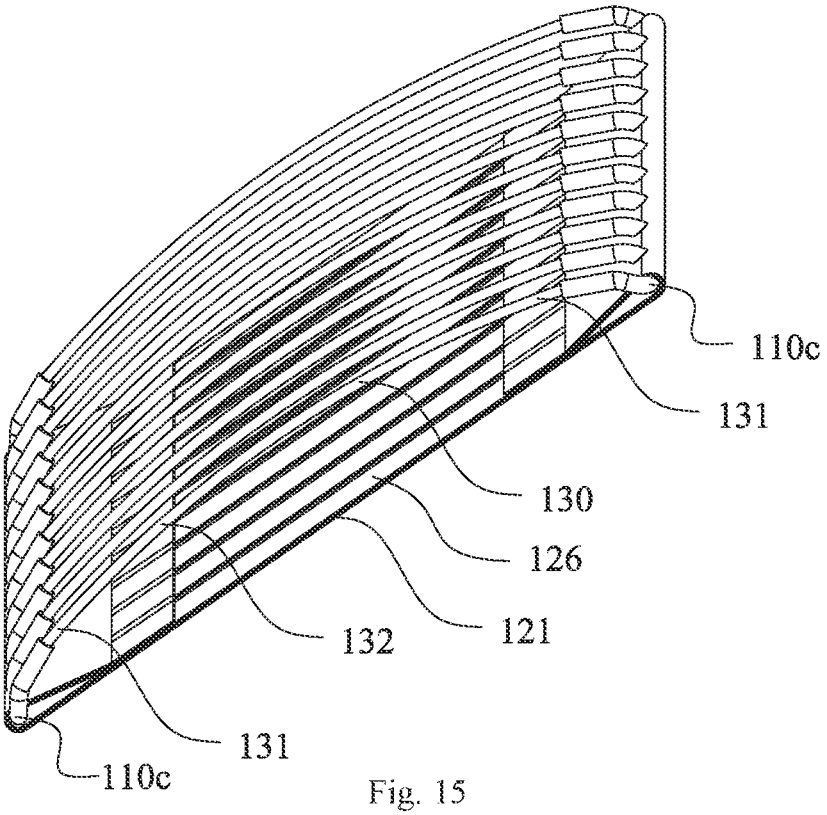
FIG. 15 is a perspective view of the cushion supporting structure in another embodiment according to the present invention.

Referring to FIGS. 14 and 15, a cushion supporting structure includes a fixing base 110*c*, a plenty of elastic members 130 and at least one flexible bearing member 121. The elastic members 130 are arranged side by side on the fixing base 110*c*, each of the elastic members 130 has symmetrical two rod ends 131, and the two rod ends 131 are respectively fixedly connected to the fixing base 110*c* in opposite directions; two opposite sides of the flexible bearing member 130 are respectively connected to the fixing base 110*c*, so as to set up the flexible bearing member 130 above the elastic members 130; the flexible bearing member 121 is pressed by a pressure and recessed downwards, it pulls the fixing bases 110*c* connected thereto to move relatively close so that the elastic members 130 are deformed; when the pressure is removed, the elastic members 130 are reset under their own elasticity, and the flexible bearing member 121 is restored to tension.

Each of the elastic members 130 has a rod body 132 connected to the two rod ends 131, and a joint each of the two rod ends 131 and the fixing base 110 is set at an obtuse angle, thereby avoiding the two sides of the flexible bearing member 130 from contacting with the rod body 132 when they are pressed.

Figure 16:
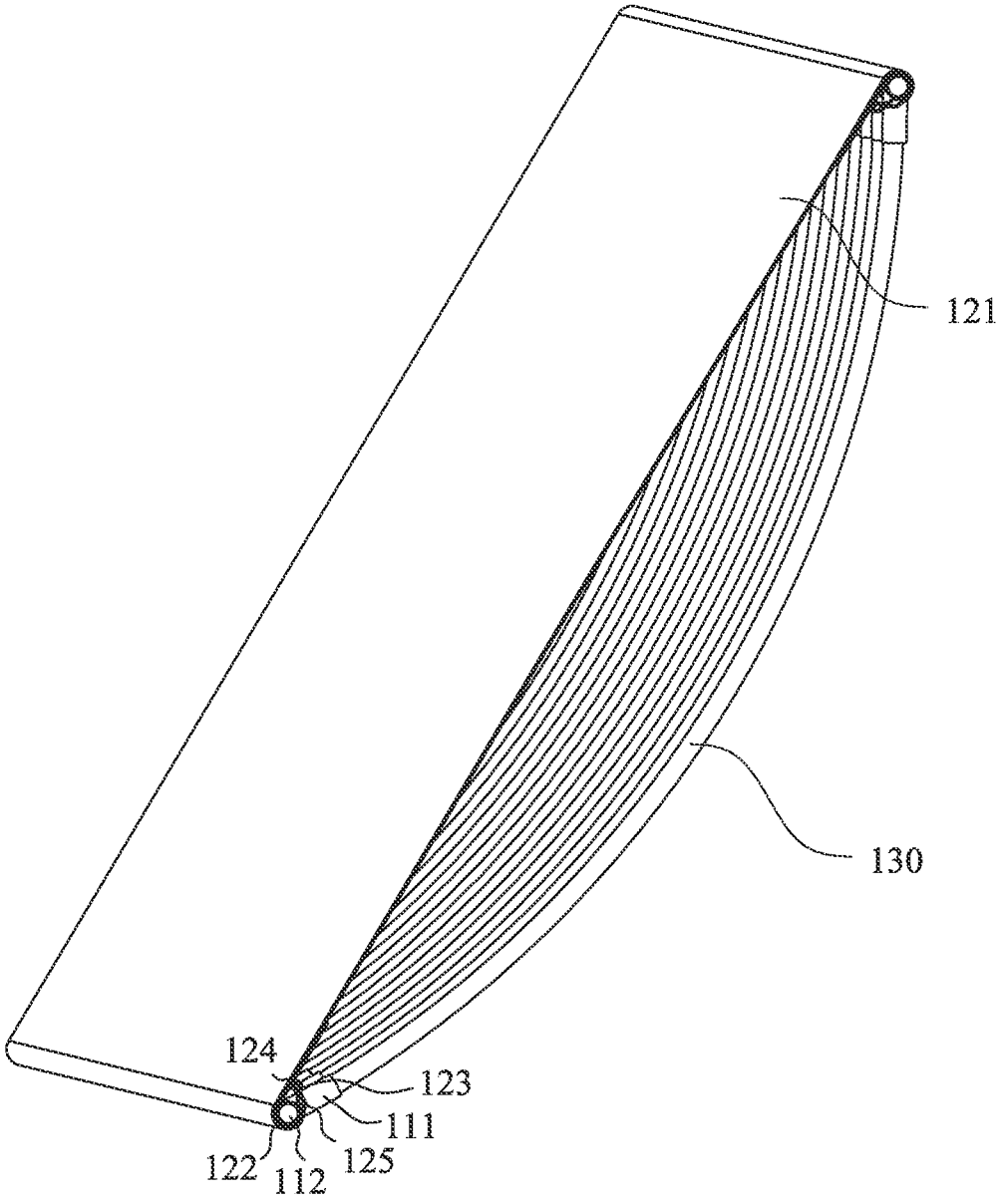
FIG. 16 is a perspective view of the cushion supporting structure in another embodiment according to the present invention.
Figure 17:
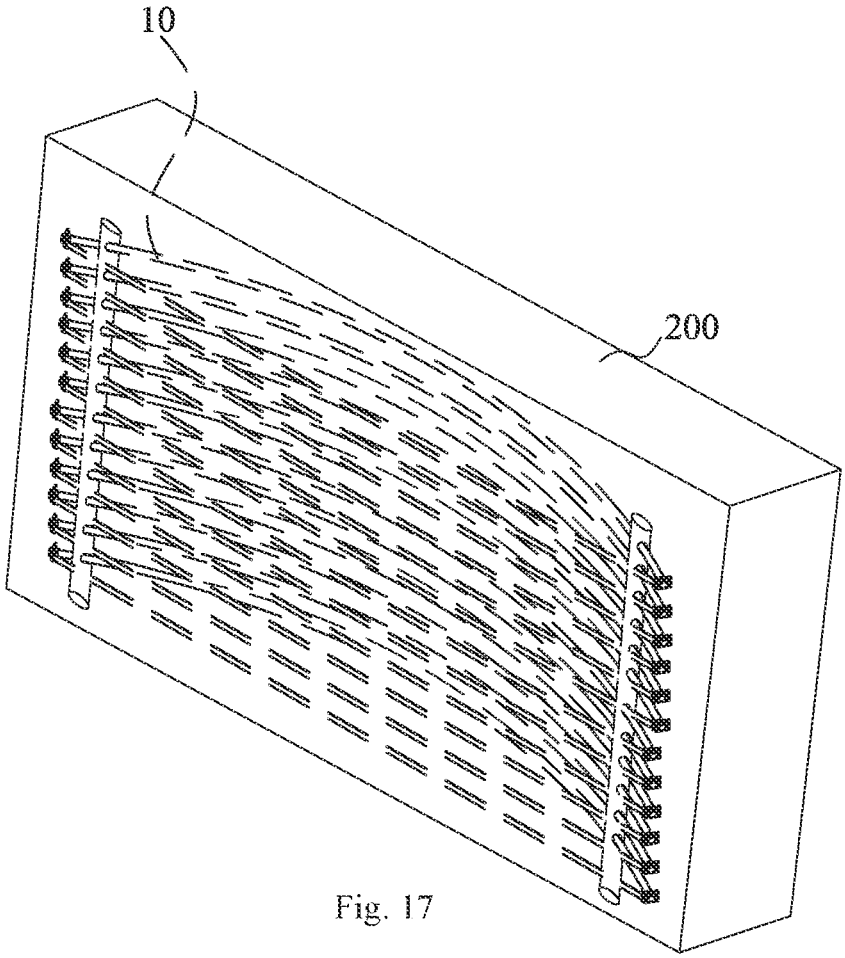
FIG. 17 is a perspective view of the cushion in another embodiment according to the present invention.

Referring to FIG. 16, the fixing base 110*c* comprises two straight connecting rods 112, multiple pairs of connecting cylinders 111 are provided on the two straight connecting rods 112, and the two rod ends 131 of each of the elastic members 130 are respectively inserted into one pair of the connecting cylinders 111, thereby realizing to install the elastic member 130 on the fixing base 110*c*.

In the embodiment, the flexible bearing member 121 is an elongated flexible strap or a block-shaped flexible knitted fabric.

The two opposite sides of the flexible bearing member 121 are respectively folded back to fit with itself to form two folding structures 122; each of the two folding structures 122 winds one of the two straight connecting rods 112, extends above the connecting cylinder 111 and forms a first perforation 123; and a positioning rod 124 passes through all of the perforations 123 formed by each of flexible bearing member 121 and is clamped on the straight connecting rod 112, thereby fixing the flexible bearing member 121 on the fixing base 110*c*.

The folding structure 122 is further provided with a second perforation 125 close to the first perforation 123, and the positioning rod 124 passes through all of the first perforations 123 or all of the second perforations 123 so as to tension the flexible bearing member.

At least one supporting belt is further provided below the flexible bearing member 121, and the supporting belt is located above any two adjacent elastic members 130; the support belt is attached to the lower surface of the flexible bearing member 121 or mounted on the fixing bases 100.

In some embodiments, referring to FIG. 6, the present invention also provides a cushion, which includes the above cushion supporting structure 100 and a coat 200 wrapping the cushion supporting structure 100. The coat 200 is made of flexible material, such as cotton, yarn, fiber, nylon, etc. The cushion can be a seat cushion, a sofa cushion, a mattress, a pillow cushion, a holding cushion, a waist cushion, a backrest cushion, an automotive seat cushion, and the like.

Preferably, the outer cover 200 is provided with an interlayer, and the interlayer is filled with a flexible filler, thereby preventing the cushion supporting structure from being uncomfortable when supporting a human body via the outer cover. The flexible filler may be a flexible substance such as cotton, sponge and latex.

Figure 18:
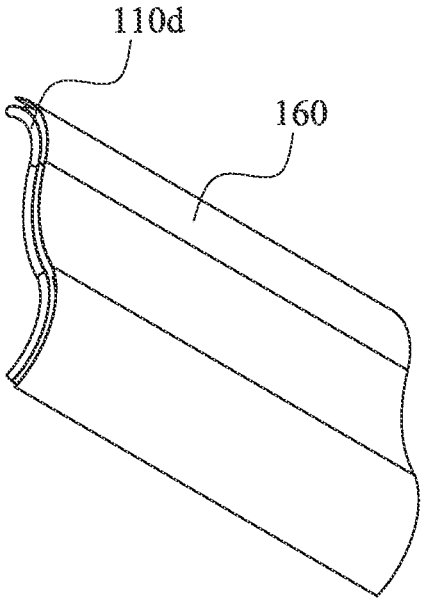
FIG. 18 is a perspective view of the pillow supporting structure according to the present invention.
Figure 19:
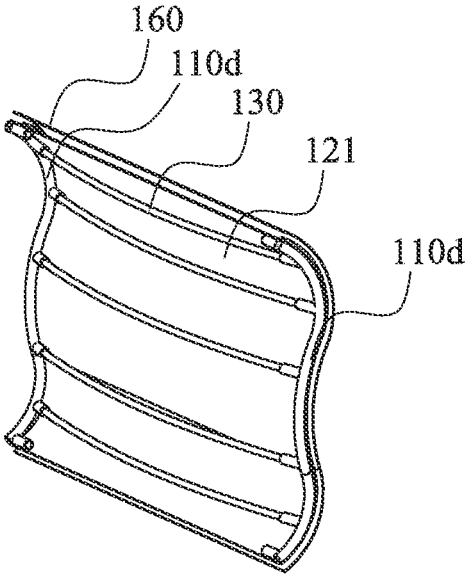
FIG. 19 is a perspective view of the pillow supporting structure in another embodiment according to the present invention.
Figure 20:
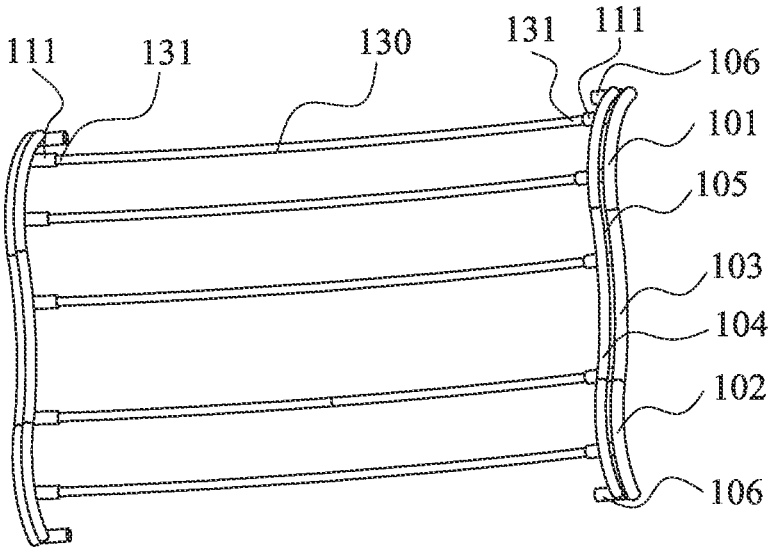
FIG. 20 is a perspective view of the pillow supporting structure after removing the flexible bearing member and the flexible pad according to the present invention.

Referring to FIG. 18-20, a pillow supporting structure includes a fixing base 110*d*, a plurality of elastic members arranged side by side on the fixing base 110*d*, and at least one flexible bearing member 121; each of the elastic members 130 has two symmetrical rod ends 131, fixed to the fixing base 110*d* in opposite directions; each of the elastic members 130 supports the fixing base 110*d*; two side edges of the flexible bearing member 121 are fixedly mounted on the fixing base 110*d*, and the flexible bearing member 121 is tensioned above the elastic members 130; when the flexible bearing member 121 is pressed by a pressure applied there to and recessed under pressure, the fixing base 110*d* connected thereto is pulled to move relatively and close, so that the elastic members 130 are driven to be deformed; when the pressure is removed, the elastic members 130 are reset under its own elasticity and push the fixing base 110*d* to reset, and the flexible bearing member 121 is also restored to tension.

The fixing base 110*d* has a first arc-shaped protrusion 101 and a second arc-shaped protrusion 102, and a concave 103 connecting the first arc-shaped protrusion 101 and the second arc-shaped protrusion 102, the first arc-shaped protrusion 101 is slightly higher than the second arc-shaped protrusion 102, so that the flexible bearing member 121 is tensioned thereon and presents a corresponding wavy shape.

The fixing base is two curved rods arranged side by side or two panels arranged side by side, each of the curved rods or top surface of each of the panels includes the first arc-shaped protrusion, the second arc-shaped protrusion, and the concave.

Specifically, the concave 103 is configured to support the head of the user, and the first arc-shaped protrusion 101 or the arc-shaped protrusion 102 is configured to support the neck of the user. When the head and the neck of the user rests on the flexible bearing member 121, the head presses the flexible bearing member 121 downwards, and the flexible bearing member 121 is pressed downwards to pull the fixing base 110*d*, thereby causing the elastic member 130 to be deformed accordingly, so that the headrest supporting structure is automatically deformed according to the physiological radian of the head of the user, so as to be automatically adapted thereto, thereby providing a more comfortable experience for the user.

The first arc-shaped protrusion 101 is slightly higher than the second arc-shaped protrusion 102, the user can choose to rest on the first arc-shaped protrusion 101 or the second arc-shaped protrusion 102 according to his habit.

It should be understood that the fixing base 110*d* can be any structure with the first arc-shaped protrusion 101, the second arc-shaped protrusion 102 and the concave 103. On the premise of not departing from the basic concept of the present invention, any change of the shape of the fixing base 110*d* shall belong to the scope of protection defined by the present application and the like.

The pillow supporting structure also further comprises a flexible pad 160 covering the flexible bearing member 121 so as to make the head and neck of the user more comfortable. It also makes the product beatify in appearance, flexible and changeable to adapt to the habits of different users.

Preferably, the fixing base 110*d* is further provided with two auxiliary curved rods 104, which are close to the two curved rods or the top surface of the two panels respectively, and formed two gaps 105 therebetween; two side edges of the flexible bearing member 121 respectively passed through the two gaps 105 to be fixed on the fixing base 110*d*. Specifically, two ends of the fixing base 110*d* are respectively provided with a mounting base 106, and two ends of the auxiliary curved rod 104 are fixed on the mounting base 106. The auxiliary curved rod 104 is preferably made of a flexible material, such as nylon, cotton cloth, sponge, and latex, so as to prevent the head of the user from directly contacting the fixed base 110*d* and the flexible bearing member 121, thereby providing a stiff feeling.

The pillow supporting structure also further comprises a flexible pad 160 covering the flexible bearing member, thereby making the head and neck of the user more comfortable. And the flexible pad also makes the pillow supporting structure beautiful, flexible, to adapt to the preferences of different users.

The pillow supporting structure further comprises a flexible interlayer, the flexible interlayer can be selectively disposed between the elastic member and the flexible bearing member, or between the flexible bearing member and the flexible pad, or on the flexible pad. The flexible interlayer is filled with fry flowers, Chinese herbal medicine, etc., which helps to sleep, in addition, it can install flexible substances such as cotton, sponge, silicone, to improve the comfort of the pillow supporting structure.

The fixing base is provided with a plurality of pairs of connecting cylinders, and the two rod ends of each of the elastic members are respectively plugged into one pair of the connecting cylinders.

In the pillow supporting structure, the structures of the elastic member and the flexible bearing member and the connection methods thereof are the same as those of the elastic member and the flexible bearing member in the cushion supporting structure. The present invention will not be repeated.

The above contents are further detailed description of the present invention with reference to preferred embodiments, and it cannot be determined that the embodiments of the present invention are only limited to these descriptions. For a person of ordinary skill in the art to which the present invention belongs, on the premise of keeping the conception of the present invention, the architecture form thereof can be flexible and varied, and a series of products can be derived. It is only a few simple deductions or replacements that should be considered as belonging to the scope of the invention as filed.

What is claimed is:

1. A cushion supporting structure comprising: a fixing base and a plurality of self-adaptive units integrated side by side and disposed on said fixing base; each of said self-adaptive units comprises a flexible bearing member and an elastic member; said elastic member supports said flexible bearing member and tension said flexible bearing member; each of said elastic members has two symmetrical rod ends, and said flexible bearing member is fixedly connected to said rod ends; when said flexible bearing member is pressed by a pressure and recessed downwards, pulling said rod ends of said elastic member connected thereto to move relatively close to one another, so that said elastic member is deformed; when said pressure is removed, said elastic member is reset under an elasticity of said elastic member, and said flexible bearing member is restored to tension;

said elastic member is an elastic rod comprising said rod ends and an arc-shaped rod body integrally;

said rod body is sheathed with a thin coat.

2. The cushion supporting structure according to claim 1, wherein a cross section of each of said rod ends is oval, circular, or polygonal in shape.

3. The cushion supporting structure according to claim 1, wherein each of said elastic members supports one of said flexible bearing members; or each of said elastic members supports a plurality of the flexible bearing members; or a plurality of said elastic members support one of said flexible bearing members.

4. The cushion supporting structure according to claim 1, wherein said flexible bearing members member is a strap or a flexible fabric block.

5. The cushion supporting structure according to claim 1, wherein each of said self-adaptive units further comprising a supporting member, supporting said elastic member to enable said elastic member to move up and down; said supporting member is disposed under, at both ends of, or above said elastic member.

6. The cushion supporting structure according to claim 1, wherein said fixing base has two straight connecting rods, each of said straight connecting rods is provided with a plurality of holes corresponding to said rod ends; each of said rod ends passes through one of said holes and is defined to move within said holes.

7. The cushion supporting structure according to claim 1, wherein said elastic member is made of epoxy fiber, aluminum alloy, carbon fiber, alumina, glass reinforced fiber, or spring steel.

8. The cushion supporting structure according to claim 1, wherein a radian of each of the elastic members is 8° 90° 8° 90°.

9. A cushion supporting structure comprising: a fixing base, a plurality of elastic members and at least one flexible bearing member; said elastic members are arranged side by side at equal intervals on said fixing base, each of said elastic members has two symmetrical rod ends, and said rod ends are respectively fixedly connected to said fixing base in opposite directions; two opposite two sides of said flexible bearing member are respectively connected to said fixing base, so as to set up said flexible bearing member above said elastic members; said flexible bearing member is deformed under a pressure, and pulls said fixing base connected thereto to move relatively close to one another so that said elastic members are deformed; when said pressure is removed, said elastic members are reset under an elasticity of said elastic members, and said flexible bearing is restored to tension;

said fixing base comprises two straight connecting rods, multiple pairs of connecting cylinders are provided on said two straight connecting rods, and said rod ends of each of said elastic members are respectively inserted into one pair of said connecting cylinders.

10. The cushion supporting structure according to claim 9, wherein each of said elastic members has a rod body connected to said rod ends, and a joint of each of said rod ends and said fixing base is set at an obtuse angle.

11. The cushion supporting structure according to claim 9, wherein said flexible bearing member is an elongated flexible strap or a block-shaped flexible knitted fabric.

12. The cushion supporting structure according to claim 9, wherein said two opposite two sides of said flexible bearing member are respectively folded back to fit with a main body portion thereof to form two folding structures; each of said two folding structures winds one of said two straight connecting rods, extends above said connecting cylinder and forms a first perforation; and a positioning rod passes through said perforation and is clamped on the straight connecting rod, thereby fixing said flexible bearing member on said fixing base.

13. The cushion supporting structure according to claim 12, wherein said folding structure is further provided with a second perforation, and said positioning rod passes through all of said first perforations or all of said second perforations so as to tension said flexible bearing member.

14. A pillow supporting structure comprising: a fixing base, a plurality of elastic members arranged side by side on said fixing base, and at least one flexible bearing member; said fixing base has a first arc-shaped protrusion, a second arc-shaped protrusion, and a concave; said concave connects said first arc-shaped protrusion and said second arc-shaped protrusion, said first arc-shaped protrusion is higher than said second arc-shaped protrusion; each of said elastic members has two symmetrical rod ends arranged on said fixing base in opposite direction to support said fixing base; two sides of said flexible bearing member are fixedly mounted on said fixing base, said flexible bearing member is tensioned above said elastic members; when said flexible bearing member is pressed by a pressure and recessed downwards, pulling said fixing base connected thereto relatively close to each other, so that said elastic members are deformed; when said pressure is removed, said elastic members are reset under an elasticity of said elastic members and push said fixing base to reset, and said flexible bearing member is also restored to tension.

15. The pillow supporting structure according to claim 14, wherein said fixing base comprises two curved rods arranged side by side, or two panels arranged side by side, each of said two curved rods or a top surface of each of said panels includes said first arc-shaped protrusion, said second arc-shaped protrusion, and said concave, so that said flexible bearing member tensioned thereon presents a corresponding wavy shape.

16. The pillow supporting structure according to claim 15, wherein said fixing base is provided with multiple pairs of connecting cylinders, and said rod ends of each of the elastic members are respectively plugged into one pair of said connecting cylinders.

17. The pillow supporting structure according to claim 15, wherein fixing base is further provided with two auxiliary curved rods, respectively closed to said two curved rods or said top surfaces of said two panel, forming two gaps therebetween; two sides of said flexible bearing member respectively pass through said two gaps to be fixed on said fixing base.

18. The pillow supporting structure according to claim 14, further comprising a flexible pad covering said flexible bearing member.

* * * * *